US005113762A

United States Patent [19]

Abendroth et al.

[11] Patent Number: 5,113,762

[45] Date of Patent: May 19, 1992

[54] INK METERING APPARATUS WITH PIVOTALLY ENGAGEABLE INK DUCT

[75] Inventors: Paul Abendroth, Offenbach am Main; Joachim Herzel, Frankfurt am Main; Peter Hummel, Offenbach am Main; Robert Ortner, Alzenau; Joachim Steuer, Offenbach am Main; Achim Stoffler, Offenbach am Main; Janko Despot, Offenbach am Main, all of Fed. Rep. of Germany

[73] Assignee: MAN Roland Druckmaschinen AG, Fed. Rep. of Germany

[21] Appl. No.: 690,854

[22] Filed: Apr. 24, 1991

[30] Foreign Application Priority Data

Apr. 24, 1990 [DE] Fed. Rep. of Germany ..... 4012949

[51] Int. Cl.[5] ..... B41F 31/04; B41F 31/06; B41G 27/08

[52] U.S. Cl. ..... 101/350; 101/363

[58] Field of Search ..... 101/350, 363, 365, 207-210; 118/261

[56] References Cited

FOREIGN PATENT DOCUMENTS 3427909 2/1987 Fed. Rep. of Germany .
3033998 4/1988 Fed. Rep. of Germany .

*Primary Examiner*—J. Reed Fisher
*Attorney, Agent, or Firm*—Leydig, Voit & Mayer

[57] ABSTRACT

A mounting device is provided for an ink duct of a printing press wherein the ink duct is supported primarily on the press frame so as to be pivotally movable with respect to a ductor roller. The ink duct carries a first guide roller which engages the ductor roller in substantially the same plane as the ink metering elements disposed in the ink duct and the ink duct carries a second guide roller which engages the ductor roller substantially vertically above its center line. A link pivoted to the ink duct carries a third guide roller which is normally biased into engagement with the ductor roller at a position disposed from the first guide roller by at least 180° measured peripherally around the ductor roller through the second guide roller. An unlocking mechanism swings the third guide roller out of engagement with the ductor roller so as to permit pivotal movement of the ink duct and guide rollers away from the ductor roller.

18 Claims, 6 Drawing Sheets

INK METERING APPARATUS WITH PIVOTALLY ENGAGEABLE INK DUCT

FIELD OF THE INVENTION

The present invention relates generally to rotary printing presses and more particularly concerns a mounting device for an ink duct pivotally movable with respect to the ductor roller of such presses.

BACKGROUND OF THE INVENTION

In rotary offset printing presses, the ink is supplied by means of ink metering elements on an ink duct cooperating with a ductor roller. In these presses a layer of ink of varying profile is produced on the ductor roller, as a result of the positioning of the ink metering elements relative to the ductor roller. To achieve optimum reproducibility of these layers of ink, it is essential that the ink duct should be mounted accurately relative to the ductor roller. It will also be understood that distortion occurs in the ink duct area and at the ductor roller due to the weight and high viscosity of the relatively thick printing ink. Nevertheless, the press operator must also be able to disengage the ink duct a sufficient distance from the ductor roller for cleaning and adjustment purposes to allow optimal operation.

To minimize distortion at the ductor roller and ink duct, it has been proposed, according to DE-OS 3,033,998, to mount the ink duct on two trunnions of the ductor roller between the two side frames. For this purpose, a bearer ring, for example in the form of a roller bearing, is provided on each roller trunnion and a mounting for securing the ink duct is disposed around it. Engagement is effected by means of a clamping element which connects the mounting (e.g., a steel band) to the ink duct. The ink duct is fixed with respect to the machine frame by means of retaining pins in enlarged bores and an elastic coupling between the ink duct and the retaining pins. In this way, when the ink duct is engaged against the ductor roller it can be slightly lifted out of its mountings, which are fixed on the machine frame.

The foregoing arrangement, however, is particularly disadvantageous inasmuch as the weight of the printing ink and ink duct have a direct effect on its suspension Also, when the ink duct is engaged with the ductor roller, additional forces from the elastic mounting at the retaining pin act on the ductor roller. Also, the ink duct can be swung away only at the defined pivot point of the retaining pins, i.e., very closely past the ductor roller. Therefore, operation is not very user-friendly, since the release and fixing of the clamping means is complex and accessibility thereto is obstructed.

Another arrangement of the ink metering system is shown in DE-PS 3,427,909. Here the ink duct is supported on the surface of the ductor roller by way of cam rollers. To ensure continuous contact between the cam rollers and the ductor roller, the ink duct is engaged with the ductor roller by means of a lever drive with the interposition of a relatively stiff spring set from the machine frame. In these conditions the ink duct is also lifted out of a pivot bearing fixed on the machine frame.

The disadvantage of this latter arrangement is that relatively large forces are required to enable the ink duct to be reliably engaged against the surface of the ductor roller. These forces must at least be such as to ensure that the ink duct is engaged with adequate forces even when fully charged with printing ink. These forces, however, act on the ductor at all times and naturally tend to bend it. Depending on the ink duct loading, the roller flexure varies, since at full duct loading there is minimal flexure, while when the ink duct is substantially empty there is maximum ductor roller flexure. The fact that the ink duct moves closely past the ductor roller also prevents the ink collecting space beneath the metering elements from being positioned so as to be readily cleaned and have a volume sufficient for long periods of operation.

Accordingly, the printing ink to be introduced into the ink duct and its effect due to weight and hydrodynamic forces, in conjunction with the manufacturing tolerances relative to the ductor roller, must be taken into account as further problems to overcome for exact positioning.

OBJECTS AND SUMMARY OF THE INVENTION

The primary aim of the present invention is to provide a mounting device for an ink duct pivotally movable with respect to the ductor roller wherein its adjustment is largely independent of the weight of the printing ink to be introduced into the ink duct while nevertheless allowing an exactly reproducible adjustment of the metering elements and compensation for production tolerances at the ductor roller or ink duct, while also improving operation by the fact that the ink duct is swingable away from the ductor roller by a greater distance to facilitate cleaning.

A mounting device is provided for an ink duct of a printing press wherein the ink duct is supported primarily on the press frame so as to be pivotally movable with respect to a ductor roller. The ink duct carries a first guide roller which engages the ductor roller in substantially the same plane as the ink metering elements disposed in the ink duct and the ink duct carries a second guide roller which engages the ductor roller substantially vertically above its center line. A link pivoted to the ink duct carries a third guide roller which is normally biased into engagement with the ductor roller at a position disposed from the first guide roller by at least 180° measured peripherally around the ductor roller through the second guide roller. An unlocking mechanism swings the third guide roller out of engagement with the ductor roller so as to permit pivotal movement of the ink duct and guide rollers away from the ductor roller.

A particularly advantageous feature of this new device for mounting the ink duct is that the weight of the duct itself and the weight of the ink to be introduced to the ink duct are largely borne by a special mounting. In these conditions the ink duct can unobstructedly follow the surface of the ductor roller as a reference surface for ink metering. Moreover, the varying loading of the ink duct with printing ink no longer has an adverse effect on ink metering. The entire arrangement is substantially free of forces and introduces only minimal external bending moments into the ductor roller. Because of the better pivotability of the preferred embodiment of the device, operation and cleaning of the ink duct are greatly simplified. In addition, the collecting space for printing ink emerging at the bottom of the metering elements is greatly increased. Finally, locking of the ink duct on the ductor roller is achieved by internal forces and operation of the device is extremely simple and reliable.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

In the description of the drawings which follows it is to be understood that the means and elements referred to for one side of the mounting arrangement are also present in mirror-image symmetry on the other side of the device.

Figure 1:
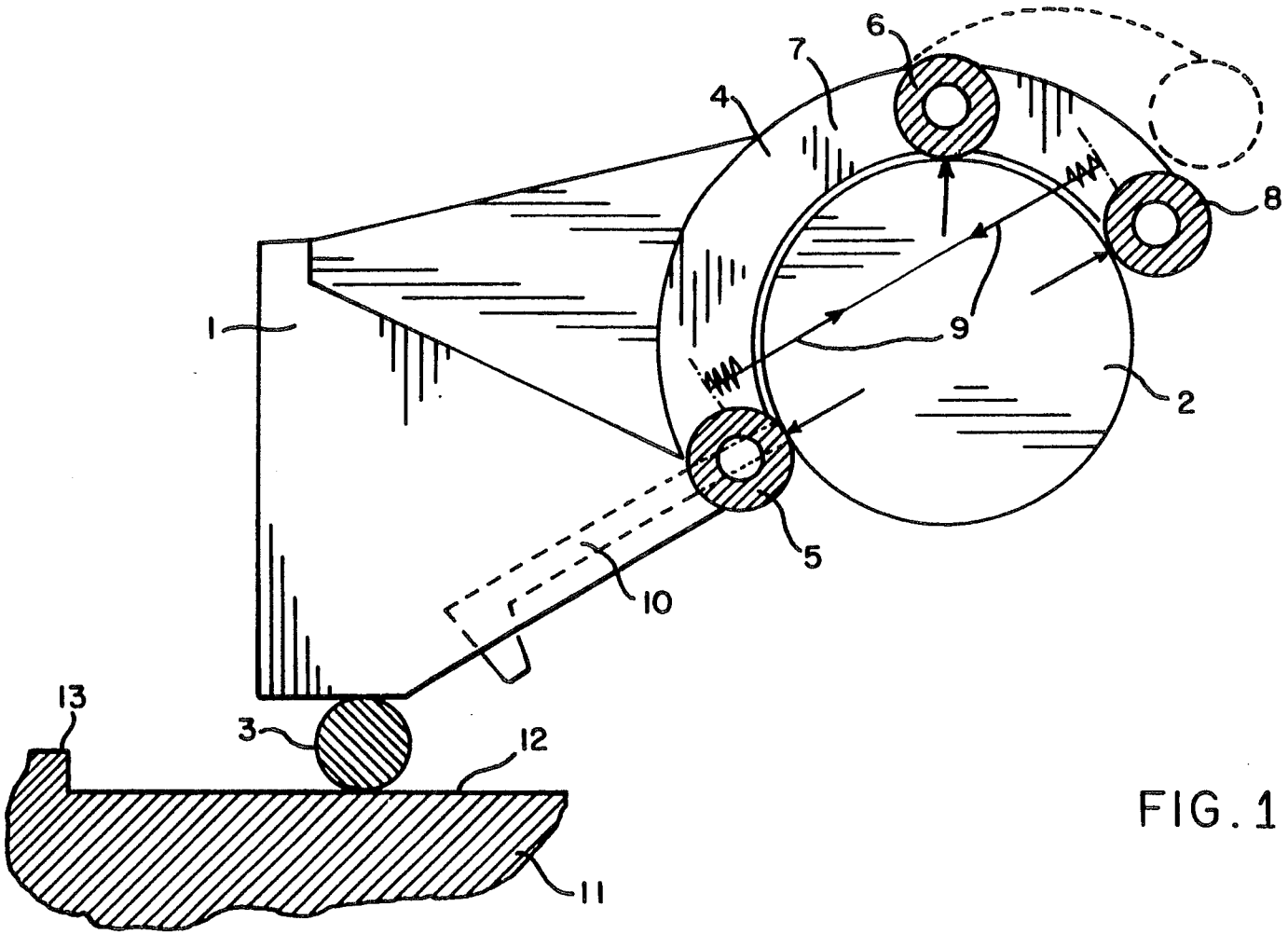
FIG. 1 is a schematic diagram showing a pivotal mounting device for an ink duct according to the present invention.

Turning now more specifically to the drawings, FIG. 1 shows in schematic form the operative relationship between an ink duct 1 and its mounting on a ductor roller 2 of a rotary printing press. This figure shows in particular how the forces from the ink duct 1 and the mounting are transmitted to the ductor roller 2 and other elements of the press. For this purpose, the ink duct 1 itself is supported on a support roller 3 which is disposed on the press frame 11. The support roller 3 takes the main weight of the ink duct 1 and printing ink present therein.

Connected to the ink duct 1 is a yoke 4, at each of the two ends of which guide rollers 5 and 6 are provided which run on the surface of the ductor roller 2. Movably connected to the first yoke 4 is a second yoke 7 which also carries a guide roller 8. Spring means 9 is provided between the first yoke 4 and the second yoke 7 for resiliently biasing the second yoke 7 with its guide roller 8 against the surface of the ductor roller 2. The spring means is supported on the first yoke 4 and in this way also pulls or pushes its guide roller 5 against the surface of the ductor roller 2.

In accordance with the invention, the arrangement of the guide rollers 5, 6 and 8 is selected so that the first guide roller 5 is situated in an upwardly-inclined, radial plane which also contains the ink metering elements 10 of the ink duct 1. The resiliently biased guide roller 8 of the second yoke 7 is preferably situated diagonally, or at least approximately diagonally opposite the first guide roller 5. The second guide roller 6 on the first yoke 4, however, is situated at the top of the ductor roller 2 so that its thrust acts vertically on the ductor surface. The forces arising out of the weight of the ink duct 1 and printing ink are now distributed over the support roller 3 disposed on the frame 11 and the contact of the second guide roller 6 on the ductor roller 2.

Because the support roller 3 on the frame is disposed closer to the center or gravity of the ink duct 1, the main weight will apply there. Thus the weight force acting on the ductor roller 2 is minimized and limited to a fraction required for reliable guidance. The biasing force in the region of the ink metering elements 10 is applied by internal forces in the yoke system 4, 7. No additional biasing force has to be produced between the machine frame 11 and the ductor roller 2. Thus, at this point no further bending moment can be transmitted to the ductor roller 2.

Nevertheless, as a result of clamping the ink duct 1 with the yoke system 4, 7 on the ductor roller 2, reliable guidance is guaranteed. Despite all manufacturing inaccuracies, such as out-of-true or eccentricity, the ink duct 1 and hence the ink metering elements 10 follow the surface of the ductor roller exactly. The reproducibility and accuracy of the metering element engagement is therefore always assured.

Pursuant to a further feature of the invention, the variations in the effects of the force at the ink duct 1 due to the filling of printing ink are restricted to a minimum. Any change in the force at the ink duct 1 or the ductor roller 2 due to the loading with printing ink is predominantly taken by the support roller 3 disposed on the frame, which, of course, carries the ink duct 1. The remaining force fraction, which is transmitted via the guide roller 6 to the ductor roller 2, can no longer produce any appreciable flexure therein.

In order to effect disengagement, the ink duct 1 is preferably connected to handling means, such as a lever drive or screw drive (not shown), which are coupled to the yoke 7 and its spring biasing means 9. To swing the ink duct 1 out of engagement, an unlocking mechanism is provided by means of which the second yoke 7 can readily be lifted so that during the pivoting out movement it can be moved away over the top point of the ductor roller surface as shown in broken lines in FIG. 1. To enable the ink duct to be disengaged from the ductor roller 2 more easily and to a further extent, a runway 12 is provided beneath the ink duct 1, the latter bearing on said runway by the support roller 3. During the disengagement movement, the ink duct 1 moves as far as a stop 13 at the end of runway 12 and is then swung rearwardly about the support roller 3. In these circumstances, it is retained by the handling means or other appropriate stops on the press frame 11.

Because of the low position of the fulcrum provided by the support roller 3, the ink duct 1 can be swung away from the ductor roller 2 to a particularly far degree in the rearward direction. An ink collecting tray at the front of the ink duct 1 is then accessibly exposed at the surface thereof. This collecting tray can therefore be made larger, because the duct is first moved away horizontally and is not pivoted until after that movement. The duct tray is thus better adapted to receive ink flowing off the ductor roller 2 and can also be more easily cleaned.

Figure 2:
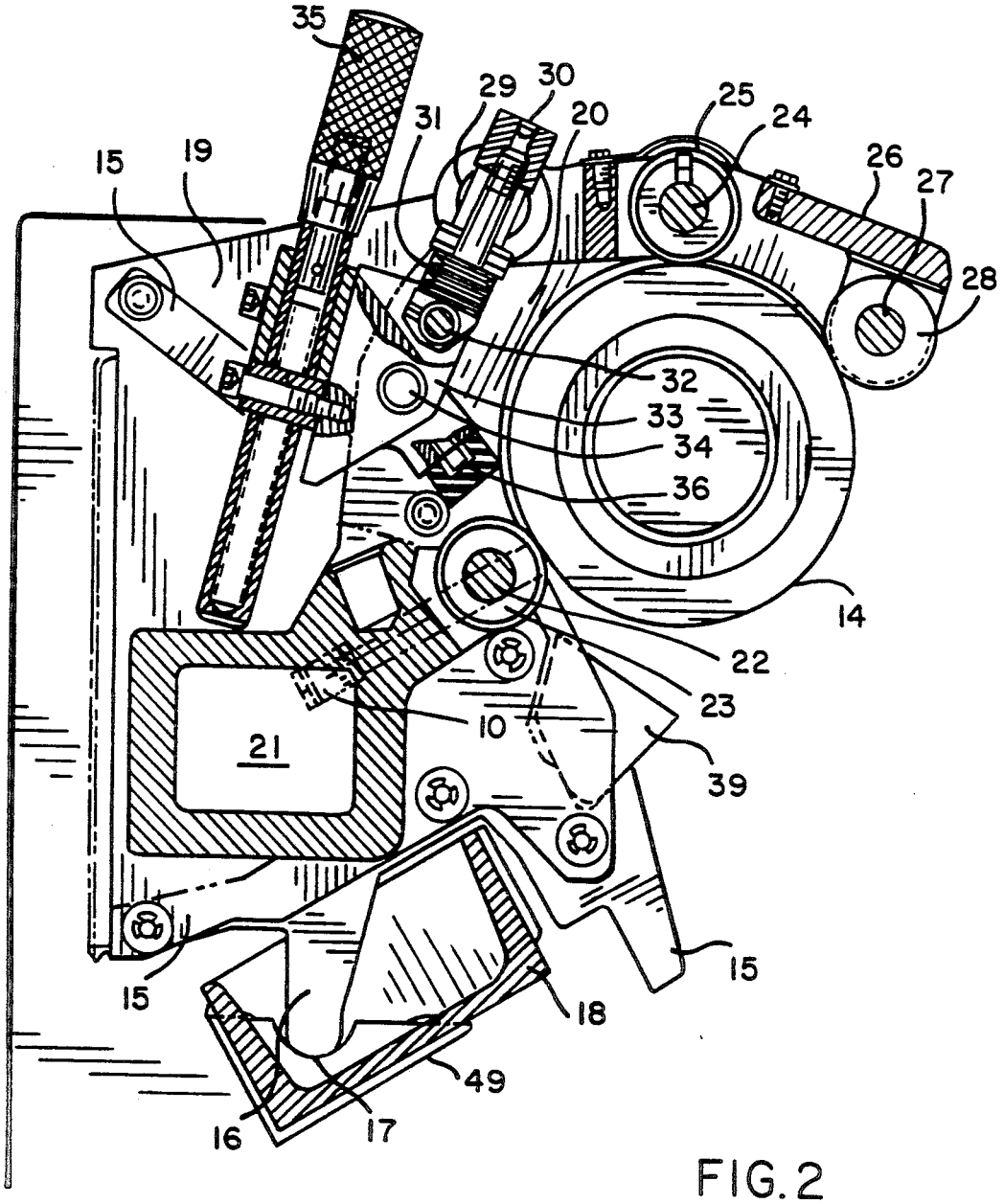
FIG. 2 is a side elevation view, partly in section of a preferred embodiment of the device shown in the engaged state.

FIG. 2 shows the constructional details of a preferred embodiment of the ink duct mounting. As illustrated here, a ductor roller 14 with the ink duct 15 in the engaged position is shown. Because FIG. 2 is primarily a side elevation view, the main parts of the ink duct 15 are concealed by the duct mounting. The ink duct 15 is supported, by a support rail 16 disposed on its underside, in a pivot mounting 17 which is fixed to the frame in a cross-member 18. A retaining element consisting of yokes 20 and of a cable housing 21 is fixed on a side wall 19 of the ink duct 15. In the preferred embodiment, two yokes 20 are disposed in parallel relationship in the axial direction of the ductor roller 14 on the cable housing 21.

To guide the ink duct 15 relative to the ductor roller 14, a guide roller 23 is journalled on a shaft 22 between the yokes 20 substantially in the plane of the ink metering elements 10. Another guide roller 25 is disposed at the top end of the yokes and is journalled on another shaft 24. Pursuant to the invention, a pivoting yoke 26 is disposed on the same shaft 24 and the yoke 26 is preferably in the form of a box which straddles the guide roller 25. A third guide roller 28 is mounted at the outer end of the yoke 26 and is journalled on a shaft 27.

To urge the third guide roller 28 into engagement with the ductor roller 14, the opposite end of yoke 26 is connected to a spring support 30 on a shaft 29. In the illustrated embodiment, the spring support 30 is supported on the shaft 29 by means of a set of cup springs 31. At the other end the spring support 30 is connected to an unlocking element 33 at a fulcrum 32. Preferably, the unlocking element 33 is mounted on a shaft 34 between the yokes 20. A handle 35 is secured to the unlocking element 33 and is slidable longitudinally against a spring. Preferably, a rubber bumper 36 is also disposed on the unlocking element 33.

The parts comprising the unlocking element 33, spring support 30 and pivoting yoke 26 form a push-over lever system. By means of the handle 35, when the duct 15 is in the swung-in position, the lever system can be pivoted into its push-over position against the force of the set of cup springs 31 so that the guide roller 28 engages the surface of the ductor roller 14. In this position, the ink duct 15 rests on the pivot bearing 17 and the guide roller 25. The center of gravity of the ink duct is offset somewhat to the right of a line perpendicular over the pivot bearing 17 so that a small portion of the weight of the ink duct 15 rests against the ductor roller 14. This ensures that the guide roller 23 rests reliably on the surface of the ductor roller 14. Thus there is a secure reference position for adjustment of the ink metering elements 10, because the latter are also situated in the upwardly-inclined, radial plane containing the two guide rollers 23.

To guarantee an absolutely secure guidance for all states of operation of the duct system, the guide roller 28 with the pivoting yoke 26 is engaged via the lever system to clamp the ink duct 15 on the ductor roller 14. Basically it is enough for the guide roller 28 to be situated in a downwardly-inclined radial plane diagonally opposite the guide roller 23. For security reasons, however, the engagement of the ductor roller 14 between the guide roller 23 and guide roller 28, including guide roller 25, is preferably selected to be somewhat more than 180° around the periphery of the ductor roller 14.

Figure 3:
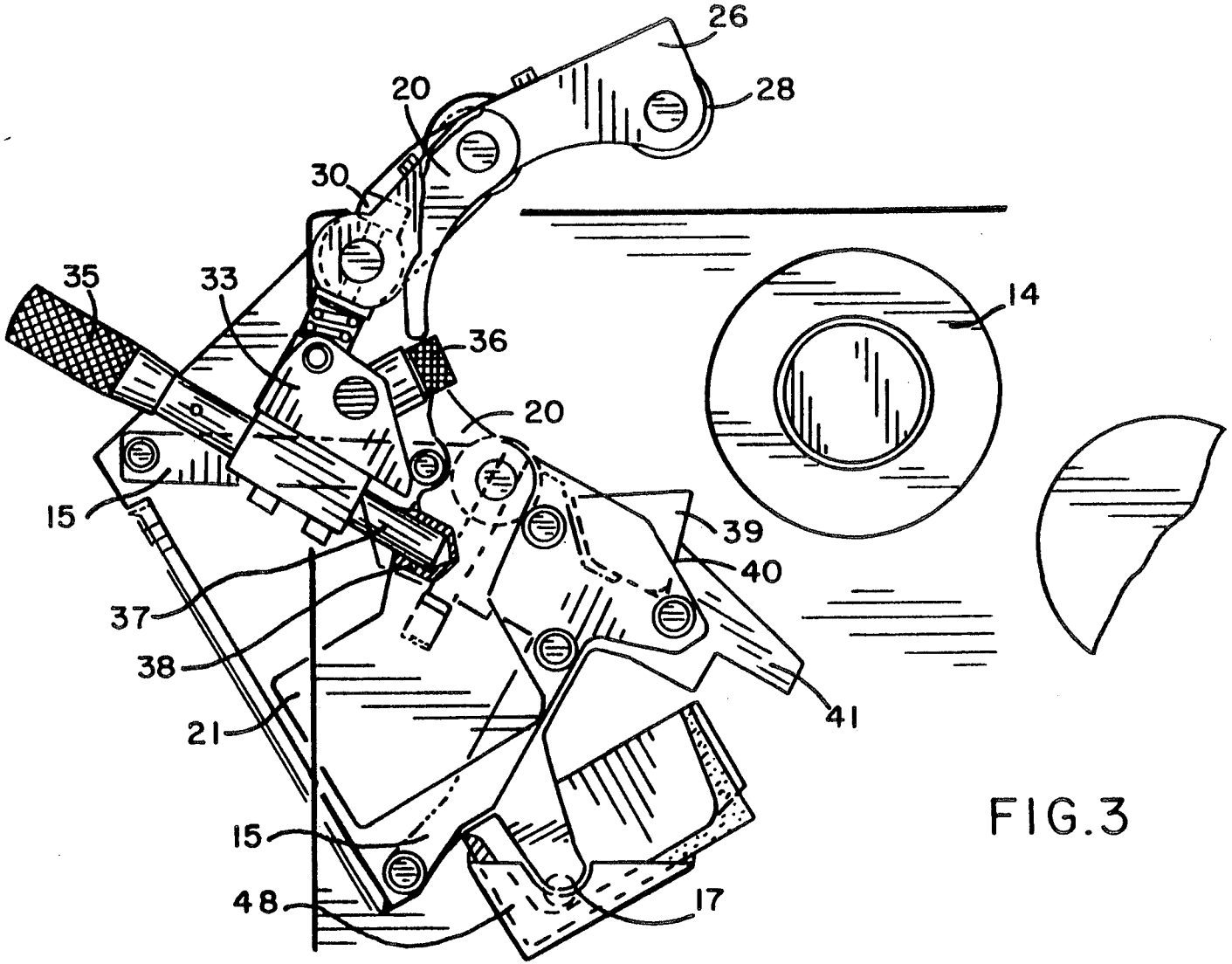
FIG. 3 is a side elevation view of the device of FIG. 2 shown in the disengaged state.

FIG. 3 shows the disengaged position of the ink duct 15. For disengagement, the handle 35 is lifted from its mounting against the spring force and moved rearwardly. In this condition the unlocking element 33 pivots around the shaft 34 and pulls the spring support 30 away in the downward direction. The push-over of the lever system is thus released and at the same time the pivoting yoke 26 together with the guide roller 28 is swung up away from the ductor roller 14 in the upward direction. The ink duct 15 is thus free and can be swung rearwardly away from the ductor roller 14 by the handle or handles 35 in the pivoting bearing 17. In the position illustrated, the bottom extension 37 of the handle 35 engages in a locking bore 38 in the cable housing 21 so that the lever system is rigidly locked to the ink duct 15. In the disengaged position, an ink collecting tray 39 normally situated in its mounting 40 at the bottom part 41 of the ink duct 15 beneath the ductor roller 14 is freely accessible. The tray 39 can easily be removed for cleaning. In addition, in the disengaged position, the rubber bumpers 36 together with the unlocking element 33 are moved into a collecting position. The disengaged position is secured by other rubber bumpers as explained in detail below with reference to FIG. 4.

When the ink duct 15 is to be engaged again, it simply has to be pushed in the direction of the ductor roller 14 by means of the handles 35. To reduce the impact on the ductor surface, the rubber bumpers 36 are the first to contact the surface of the ductor roller 14. The handles 35 are then again pulled against the force of the springs and the lever system consisting of the unlocking elements 33, spring support 30 and pivoting yoke 26 can again be swung into the pushed-over position to secure the ink duct 15 against the ductor roller 14. At the same time the rubber bumpers 36 are swung down away from the surface of the ductor roller 14.

Figure 4:
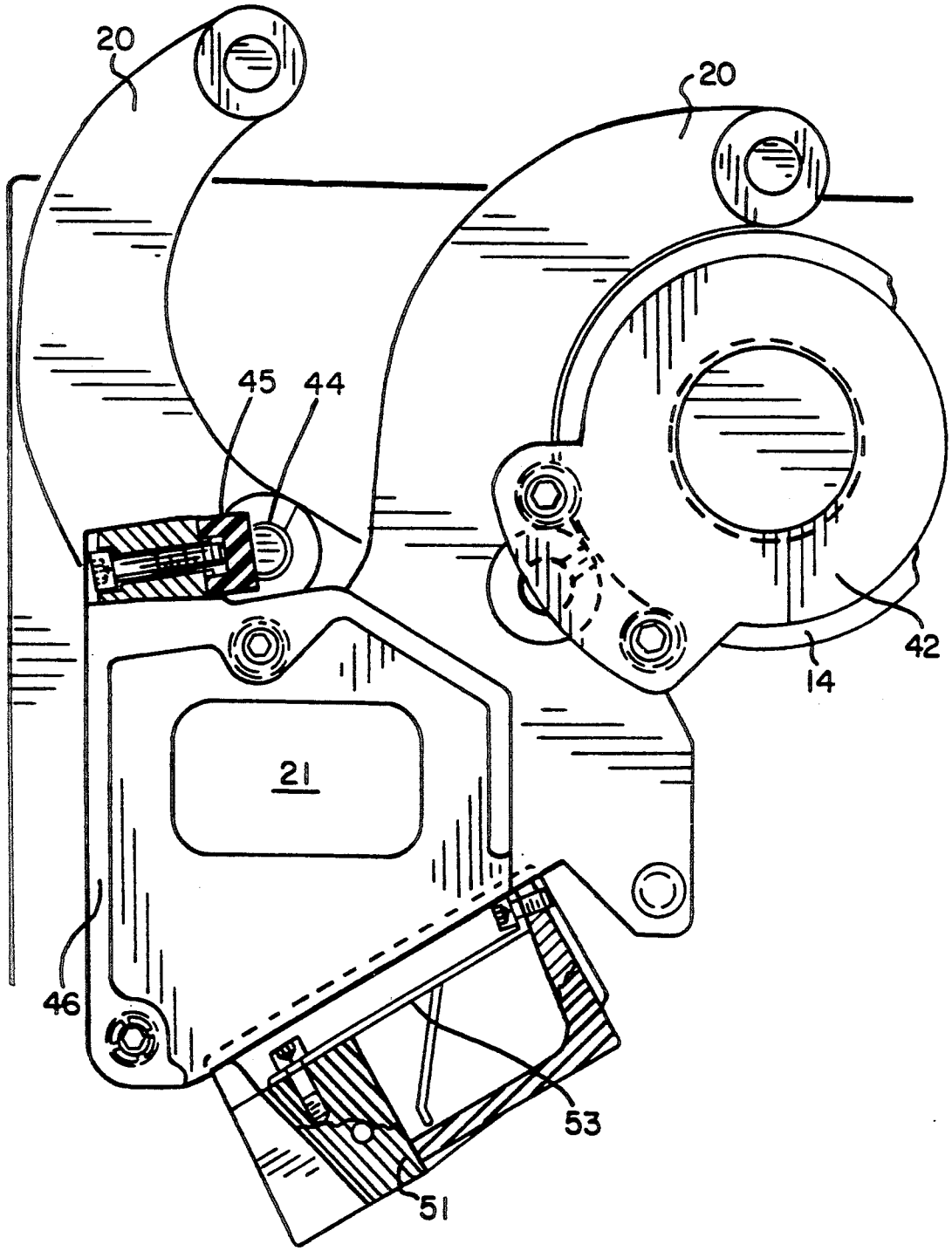
FIG. 4 is an enlarged, fragmentary side elevation view of the device of FIGS. 2 and 3 showing certain elements in both the engaged and disengaged states.
Figure 5:
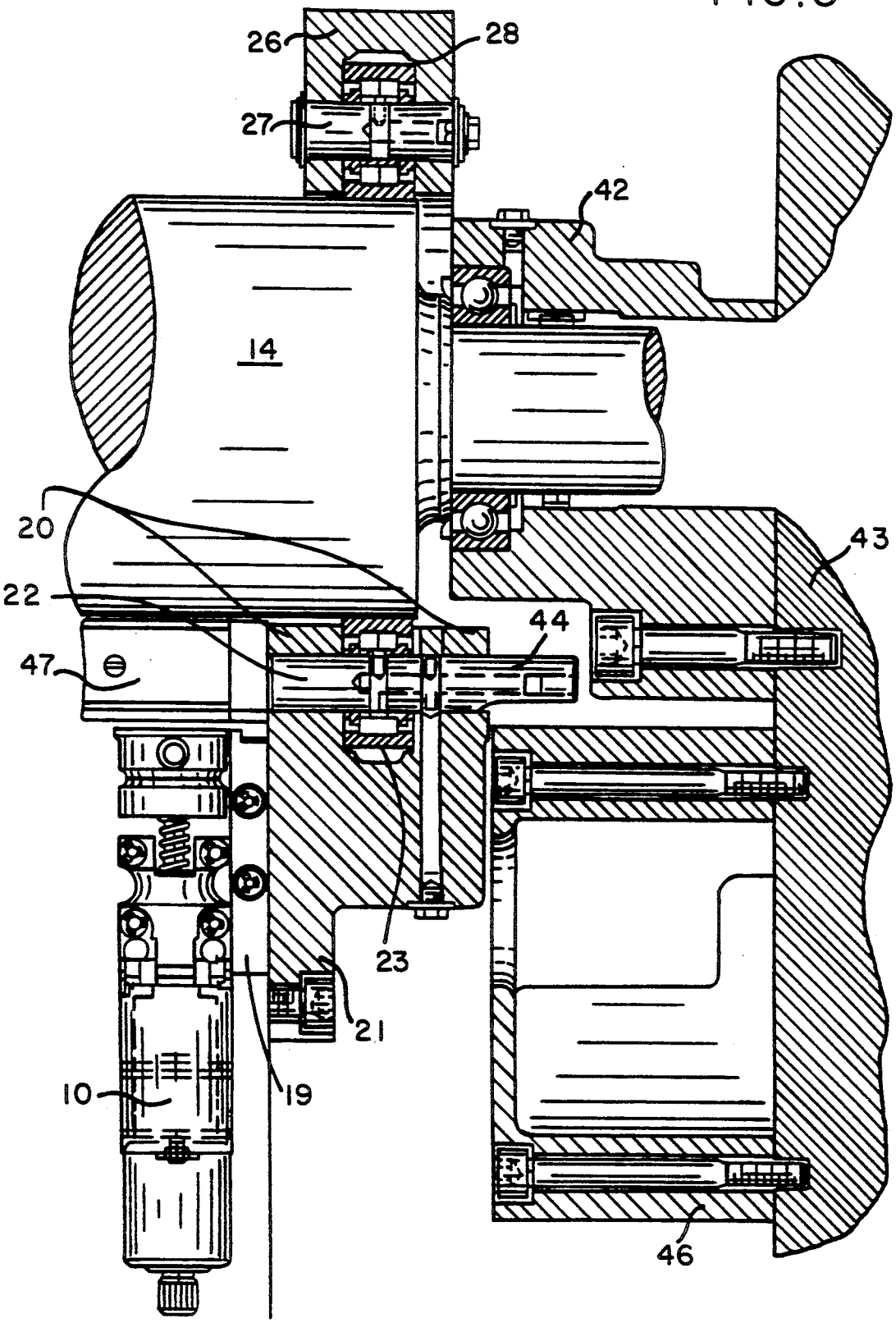
FIG. 5 is a fragmentary plan view, partly in section of one side of the mounting device for the ink duct at the ductor roller.

FIGS. 4 and 5 illustrate in greater detail the arrangement of the duct mounting relatively to the parts fixed to the press frame. In the engaged condition of the ink duct, the yokes 20 engage around a roller mounting 42 mounted on the side frame 43. In the disengaged condition the duct bears, in the region of the guide rollers 23, against further rubber bumpers 45 by the shaft 22 of the guide rollers 23, which is extended in the outward direction to form a stop 44. Preferably, the rubber bumpers 45 are mounted on a cable housing 46 which is fixed to the frame and which is situated opposite the cable housing 21 on the ink duct 15.

FIG. 5 additionally shows that the pivoting yoke 26 is constructed in the form of a box and carries the guide roller 28 on the shaft 27 between its side wall. Diagonally opposite on the other side of the ductor roller 14, the guide roller 23 is disposed on the shaft 22. In the illustrated embodiment, the side walls of the cable housing 21 laterally of the guide roller 23 form the bottom end of the yokes 20, which at their top end accommodate the guide roller 25 on the shaft 24 and the pivoting yoke 26. The cable housing 21 and yokes 20 are directly connected to the duct side wall 19, adjoining which are also the ink metering element 10. Also as shown in FIG. 5, a drip plate 47 is disposed in front of the ink metering elements and normally ensures controlled discharge of dripping ink into the ink collecting tray 39 beneath the ductor roller 14. As previously mentioned, the arrangement shown in FIG. 5 applies, with mirror-image symmetry, to the other side of the ductor roller 14 as well.

Figure 6:
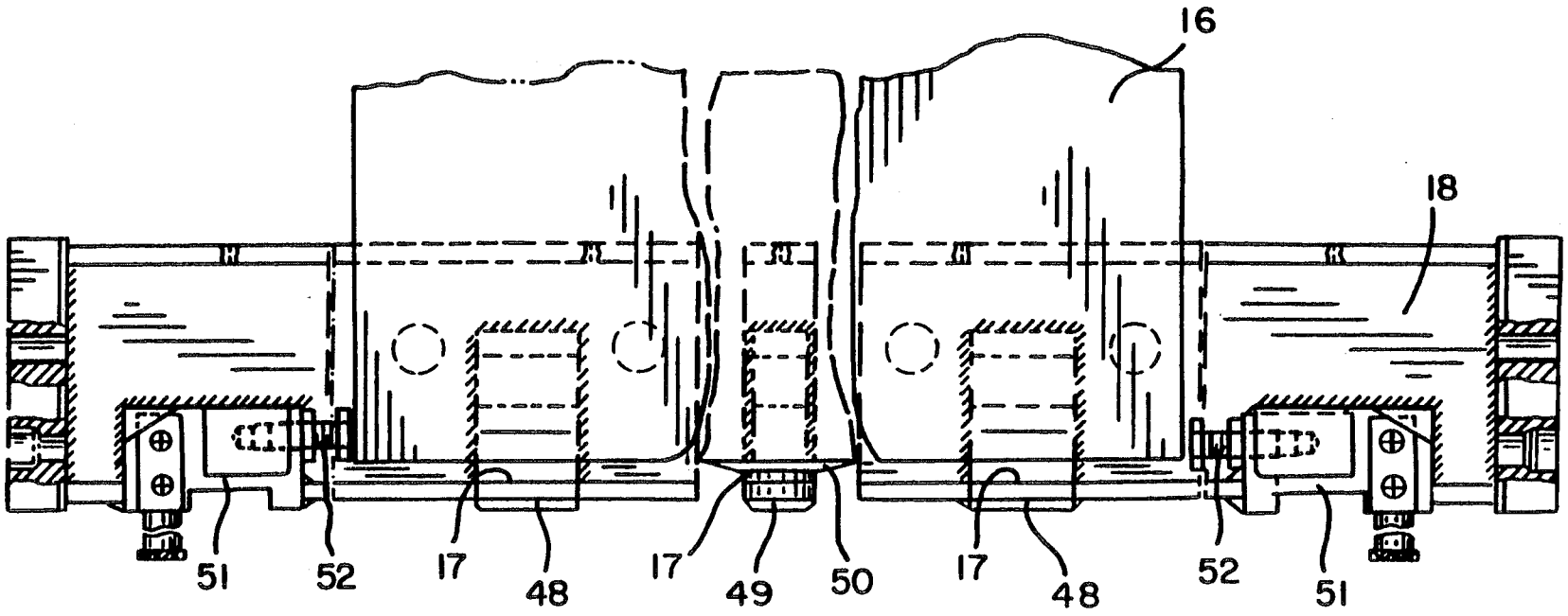
FIG. 6 is a fragmentary plan view of a cross member for supporting the mounting device.

Referring now to FIG. 6, the cross-member 18 is shown in plan view. The support rail 16 and hence the ink duct 15 are supported on this cross-member 18 and preferably, pivot bearings 17 are recessed into the cross-member 18. As will be seen from FIG. 3, the pivot bearings 17 are inserted into the cross-member 18 in the form of separate bearing elements 48 and 49. Normally, a narrow bearing element 49 is provided in the middle of the cross-member 18 and two more bearing elements 48 are spaced laterally of the bearing element 49 at equal distances.

In the illustrated embodiment, the support rail 16 is raised somewhat in the middle in the region of the bearing element 49. Thus when the ink duct 15 is engaged, it is borne by the support rail 16 on only the middle bearing element 49, thus giving a statically determinate support for the duct. A support surface 50 with a height of about 0.5 mm is thus provided in the middle of the support rail 16.

In the disengaged state, the ink duct 15 can tip laterally to the left or right on to one or the other bearing elements 48. To achieve axial centering of the ink duct 15, adjustment pads 51 are preferably provided laterally of the bearing elements 48, and adjusting screws 52 secured by locknuts are provided on each pad. In the preferred embodiment, the adjusting screws 52 are set so as to allow a minimal lateral movement of the ink duct 15 with its support rail 16. To protect the cross-member from any accumulation of dirt, a cover plate 53 is fitted so that the support rail 16 of the ink duct 15 remains freely movable.

In accordance with the mounting device of the invention, the handling of the ink duct 15 is extremely simplified because the load on the ductor roller 14 is reduced as far as possible. Also, for assembly and dismantling purposes, the entire ink duct 15 can very easily be removed from the machine. No complicated assembly is necessary for replacement, and the ink duct 15 automatically adjusts when engaged against the ductor roller 14. Furthermore, there are no external forces applied between the machine frame and the ductor roller for engagement purposes.

Pursuant to the present invention, it will also be understood that in the event of considerable deviations of position or tolerances, or for refitting to older printing machines, the support surface 50 or alternatively the bearing element 49 can be vertically adjustable. Normally it is immaterial whether the ink duct 15 is engaged with the ductor roller 14 at a somewhat higher or lower level. In such cases, of course, the ink metering elements 10 have a slightly different position at the periphery of the ductor roller 14, but this has no effect on the function of the complete arrangement.

We claim as our invention:

1. A mounting device for an ink duct pivotally movable with respect to a ductor roller in a rotary printing press having a supporting press frame, said mounting device comprising, in combination, means secured to said ink duct and bearing on said press frame for supporting said ink duct for pivotal movement, ink metering means disposed in said ink duct and projecting therefrom for engagement with said ductor roller substantially in an upwardly-inclined first radially extending plane, a first guide roller and means for journalling said first guide roller for engagement with said ductor roller substantially in said first radially extending plane, a second guide roller and means for journalling said second guide roller for engagement with the upper surface of said ductor roller substantially in a vertical plane intersecting the axis of said ductor roller, a third guide roller and means for journalling said third guide roller for engagement with said ductor roller substantially in a downwardly-inclined, second radially extending plane, said third guide roller being disposed from said first guide roller by at least 180° measured peripherally around said ductor roller through said second guide roller, means for normally urging said third guide roller into engagement with said ductor roller so as to hold said ductor roller in engagement with said first and second guide rollers, and means for moving said third guide roller out of engagement with said ductor roller so as to permit pivotal movement of said ink duct and said guide rollers away from said ductor roller.

2. A mounting device according to claim 1 including a support rail secured to the underside of said ink duct, said support rail being formed with a slightly raised central support surface, and a cross member fixed to the press frame, said cross member being formed with at least one bearing element against which said central support surface is engaged to support said ink duct.

3. A mounting device according to claim 2 wherein said support surface rises only about 0.3 to 0.5 mm. above the lower edge of said support rail and has a width slightly wider than said bearing element.

4. A mounting device according to claim 1 wherein fixed arcuate yokes are mounted at both ends of said ink duct, said first and second guide rollers being journalled respectively adjacent the arcuate ends of said fixed yokes, and movable arcuate yokes are pivotally mounted on said fixed arcuate yokes adjacent said second guide roller, said third guide roller being journalled on the free end of said movable arcuate yokes.

5. A mounting device according to claim 4 including spring means for biasing said movable yokes so as to urge said third guide roller into engagement with said ductor roller and means for locking said movable yokes and said third roller is said engaged position.

6. A mounting device according to claim 5 including lever means for unlocking said movable yokes for pivotal movement on said fixed yokes.

7. A mounting device according to claim 6 wherein said lever means is operative to pivot said ink duct away from said ductor roller when said locking means is unlocked.

8. A mounting device according to claim 7 wherein said lever means includes a handle and a spring support, said spring support being pivotally connected to said unlocking means and to said pivotally movable yokes.

9. A mounting device according to claim 8 wherein said handle is displaceable against said spring and has an extension, and said locking means includes a bore connected to said fixed yokes, said extension engaging in said bore when said lever is in the unlocked condition.

10. A mounting device according to claim 9 wherein damping elements are provided between said ink duct and said ductor roller and between said ink duct and said press frame.

11. A mounting device according to claim 10 wherein said damping elements include a rubber bumper disposed on said unlocking means so that when the ink duct is pivoted into engagement with the handle engaged said rubber bumper meets said ductor roller in front of the first guide roller and, on locking, by puching-over of the lever means, is swung away from the surface of the ductor roller.

12. A mounting device according to claim 11 wherein said damping elements include additional rubber bumpers fixed to the machine frame and which cooperated with stops on the ink duct on disengagement.

13. A mounting device according to claim 12 wherein said additional rubber bumpers are mounted on the press side frame and said stops are extensions of a shaft of the first guide roller in the plane of said ink metering elements.

14. A mounting device according to claim 13 wherein three bearing elements are provided in the cross-member, a meddle of said bearing elements one being associated with a central support surface on the support and carrying the associated pivot bearing, and an outer two of said bearing elements are provided with similar pivot bearings.

15. A mounting device according to claim 3 wherein at least one of said support surface and said bearing elements is vertically adjustable.

16. A mounting device according to claim 10 wherein said damping elements provided between the ink duct and the press frame are shock absorbers, each such shock absorber being pivotally connected to the ink duct and the press frame.

17. A mounting device according to claim 1, wherein said ink duct rests on support rollers on runways fixed to the press frame, and said runways are provided with stops at the end thereof remote from the ductor roller.

18. A mounting device according to claim 17 including drive means for disengaging said ink duct from said ductor roller, said ink duct pivots about the axis of said support rollers engaging said stops.

* * * * *